US008813395B2

(12) United States Patent
Beers et al.

(10) Patent No.: US 8,813,395 B2
(45) Date of Patent: Aug. 26, 2014

(54) ARTICLE OF FOOTWEAR INCORPORATING ILLUMINABLE STRANDS

(71) Applicant: Nike, Inc., Beaverton, OR (US)

(72) Inventors: Tiffany A. Beers, Portland, OR (US); Jeffrey C. Spanks, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 13/905,917

(22) Filed: May 30, 2013

(65) Prior Publication Data

US 2013/0333250 A1 Dec. 19, 2013

Related U.S. Application Data

(63) Continuation of application No. 12/704,110, filed on Feb. 11, 2010, now Pat. No. 8,453,357.

(51) Int. Cl.
*A43B 23/00* (2006.01)

(52) U.S. Cl.
USPC ..... 36/137

(58) Field of Classification Search
USPC ..... 36/137, 50.1; 362/103; D2/972
See application file for complete search history.

(56) References Cited

U.S. PATENT DOCUMENTS

| | | | |
|---|---|---|---|
| 1,184,396 | A | 5/1916 | Trimble |
| 1,949,318 | A | 2/1934 | Markowsky |
| 2,205,356 | A | 6/1940 | Gruensfelder et al. |
| 2,372,903 | A | 4/1945 | Lynch |
| 2,545,809 | A | 3/1951 | Faulk |
| D174,987 | S | 6/1955 | Gillis |
| 3,008,038 | A | 11/1961 | Dickens et al. |
| 3,070,907 | A | 1/1963 | Rocco |
| 3,484,881 | A | 12/1969 | Krieger et al. |
| 3,505,131 | A | 4/1970 | Wells |
| 3,595,657 | A | 7/1971 | Robinson et al. |
| 3,893,247 | A | 7/1975 | Dana, III |
| 3,946,505 | A | 3/1976 | Dana, III |
| 4,130,951 | A | 12/1978 | Powell |
| 4,234,907 | A | 11/1980 | Daniel |
| 4,253,253 | A | 3/1981 | McCormick |
| D283,364 | S | 4/1986 | Gamm |
| 4,651,447 | A | 3/1987 | Sullivan |

(Continued)

FOREIGN PATENT DOCUMENTS

| | | |
|---|---|---|
| EP | 0121026 | 10/1984 |
| EP | 0534560 | 3/1993 |

(Continued)

OTHER PUBLICATIONS

Office Action dated Oct. 12, 2012 in U.S. Appl. No. 12/704,126.

(Continued)

*Primary Examiner* — Ted Kavanaugh
(74) *Attorney, Agent, or Firm* — Plumsea Law Group, LLC

(57) ABSTRACT

An article of footwear may include an upper and a sole structure secured to the upper. The upper includes at least one illuminable strand located to be visible from an exterior of the article of footwear. In some configurations, the upper includes a power source at least partially embedded within the upper and electrically-coupled to the illuminable strand. In another configuration, the upper includes a foundation layer and a cover layer that are secured to each other, and the illuminable strand is located between the foundation layer and the cover layer.

20 Claims, 10 Drawing Sheets

(56) References Cited

U.S. PATENT DOCUMENTS

| | | | | |
|---|---|---|---|---|
| 4,748,366 | A | 5/1988 | Taylor | |
| 4,756,098 | A | 7/1988 | Boggia | |
| 4,848,009 | A | 7/1989 | Rodgers | |
| 4,858,339 | A | 8/1989 | Hayafuchi et al. | |
| 4,999,936 | A | 3/1991 | Calamia et al. | |
| 5,033,212 | A | 7/1991 | Evanyk | |
| 5,052,131 | A * | 10/1991 | Rondini | 36/137 |
| 5,165,190 | A | 11/1992 | Smyth | |
| 5,188,447 | A | 2/1993 | Chiang et al. | |
| 5,209,000 | A | 5/1993 | Rowland et al. | |
| 5,303,131 | A | 4/1994 | Wu | |
| 5,303,485 | A | 4/1994 | Goldston et al. | |
| 5,329,432 | A | 7/1994 | Bland | |
| 5,359,790 | A | 11/1994 | Iverson et al. | |
| 5,381,615 | A | 1/1995 | MacMillan | |
| 5,396,720 | A | 3/1995 | Hwang et al. | |
| 5,406,724 | A | 4/1995 | Lin | |
| 5,408,764 | A | 4/1995 | Wut | |
| 5,421,106 | A | 6/1995 | Emrick | |
| 5,438,488 | A | 8/1995 | Dion | |
| 5,457,900 | A | 10/1995 | Roy | |
| 5,461,188 | A | 10/1995 | Drago et al. | |
| 5,483,759 | A | 1/1996 | Silverman | |
| 5,490,338 | A | 2/1996 | Hwang et al. | |
| 5,495,136 | A | 2/1996 | Chiang et al. | |
| 5,546,681 | A | 8/1996 | Goldston et al. | |
| 5,572,817 | A | 11/1996 | Chien | |
| 5,599,088 | A | 2/1997 | Chien | |
| 5,611,621 | A | 3/1997 | Chien | |
| 5,649,755 | A | 7/1997 | Rapisarda | |
| 5,704,705 | A | 1/1998 | Chien | |
| 5,732,486 | A | 3/1998 | Rapisarda | |
| 5,737,854 | A | 4/1998 | Sussmann | |
| 5,746,499 | A | 5/1998 | Ratcliffe et al. | |
| 5,765,300 | A | 6/1998 | Kianka | |
| 5,771,611 | A | 6/1998 | Chang | |
| 5,794,366 | A | 8/1998 | Chien | |
| 5,806,960 | A | 9/1998 | Chien | |
| 5,812,063 | A | 9/1998 | Weng et al. | |
| 5,813,148 | A * | 9/1998 | Guerra | 36/137 |
| 5,857,273 | A | 1/1999 | Rapisarda | |
| 5,860,727 | A | 1/1999 | Chien | |
| 5,865,523 | A | 2/1999 | Chien | |
| 5,866,987 | A | 2/1999 | Wut | |
| 5,869,930 | A | 2/1999 | Baumberg et al. | |
| 5,879,069 | A | 3/1999 | Chien | |
| 5,894,201 | A | 4/1999 | Wong | |
| 5,894,686 | A | 4/1999 | Parker et al. | |
| 5,909,088 | A | 6/1999 | Wut | |
| 5,930,921 | A | 8/1999 | Sorofman et al. | |
| 5,945,911 | A | 8/1999 | Healy et al. | |
| 5,947,580 | A | 9/1999 | Chien | |
| 5,955,957 | A * | 9/1999 | Calabrese et al. | 340/691.8 |
| 5,969,479 | A | 10/1999 | Wong | |
| 6,012,822 | A | 1/2000 | Robinson | |
| 6,017,128 | A | 1/2000 | Goldston et al. | |
| 6,030,089 | A | 2/2000 | Parker et al. | |
| 6,052,921 | A | 4/2000 | Oreck | |
| 6,104,140 | A | 8/2000 | Wut et al. | |
| 6,112,437 | A | 9/2000 | Lovitt | |
| 6,164,794 | A | 12/2000 | Rodgers | |
| 6,280,045 | B1 | 8/2001 | Anteby et al. | |
| 6,457,261 | B1 | 10/2002 | Crary | |
| 6,619,812 | B2 | 9/2003 | Rapisarda | |
| 6,669,151 | B2 | 12/2003 | Mascadri | |
| 6,754,983 | B2 | 6/2004 | Hatfield et al. | |
| 6,764,193 | B1 | 7/2004 | Wei | |
| 6,789,913 | B2 | 9/2004 | Wei | |
| 6,837,590 | B2 | 1/2005 | Marston | |
| 6,843,578 | B1 | 1/2005 | Cheung | |
| 6,862,820 | B2 | 3/2005 | Farys et al. | |
| 6,910,288 | B2 | 6/2005 | Dua | |
| 6,991,342 | B2 | 1/2006 | Gomet | |
| 7,054,784 | B2 | 5/2006 | Flentov et al. | |
| 7,114,822 | B2 | 10/2006 | Guzman | |
| 7,147,337 | B1 | 12/2006 | Rapisarda | |
| 7,171,331 | B2 | 1/2007 | Vock et al. | |
| 7,178,929 | B2 | 2/2007 | Guzman | |
| 7,181,870 | B2 | 2/2007 | Guzman | |
| D551,438 | S * | 9/2007 | Laberge | D2/972 |
| 7,270,616 | B1 | 9/2007 | Snyder | |
| 7,329,019 | B2 | 2/2008 | Cheung | |
| D580,155 | S * | 11/2008 | Banik | D2/969 |
| 7,494,237 | B1 | 2/2009 | Cheung | |
| D595,499 | S | 7/2009 | Dekovic | |
| 7,774,956 | B2 | 8/2010 | Dua et al. | |
| 7,870,682 | B2 | 1/2011 | Meschter et al. | |
| 7,996,924 | B2 | 8/2011 | Wright et al. | |
| 8,001,705 | B2 | 8/2011 | Cagliari | |
| 8,034,273 | B2 | 10/2011 | Lalande et al. | |
| 8,122,616 | B2 | 2/2012 | Meschter et al. | |
| 8,132,340 | B2 | 3/2012 | Meschter | |
| 8,266,827 | B2 | 9/2012 | Dojan et al. | |
| 8,453,357 | B2 | 6/2013 | Beers et al. | |
| 8,544,197 | B2 | 10/2013 | Spanks et al. | |
| 2001/0024364 | A1 * | 9/2001 | Hurwitz | 362/84 |
| 2003/0070324 | A1 | 4/2003 | Nelson | |
| 2004/0103563 | A1 | 6/2004 | Linge | |
| 2004/0181972 | A1 | 9/2004 | Csorba | |
| 2004/0255490 | A1 | 12/2004 | Wan et al. | |
| 2005/0018417 | A1 | 1/2005 | Chien | |
| 2005/0018450 | A1 | 1/2005 | Chien | |
| 2005/0183294 | A1 | 8/2005 | Guzman | |
| 2005/0193592 | A1 | 9/2005 | Dua et al. | |
| 2005/0207138 | A1 | 9/2005 | Cheung | |
| 2005/0268497 | A1 | 12/2005 | Alfaro et al. | |
| 2005/0284000 | A1 | 12/2005 | Kerns | |
| 2005/0286244 | A1 | 12/2005 | Weng | |
| 2005/0286248 | A1 | 12/2005 | Weng | |
| 2006/0007668 | A1 | 1/2006 | Chien | |
| 2006/0007670 | A1 | 1/2006 | Chien | |
| 2006/0101674 | A1 | 5/2006 | Ungari | |
| 2006/0104046 | A1 | 5/2006 | Guzman | |
| 2006/0130373 | A1 * | 6/2006 | Snyder | 36/137 |
| 2006/0198121 | A1 | 9/2006 | Thorpe et al. | |
| 2006/0221596 | A1 | 10/2006 | Chang | |
| 2006/0229149 | A1 | 10/2006 | Goedoen | |
| 2006/0262517 | A1 | 11/2006 | Doerer et al. | |
| 2007/0028486 | A1 * | 2/2007 | Montanya et al. | 36/137 |
| 2007/0041193 | A1 | 2/2007 | Wong et al. | |
| 2007/0147026 | A1 | 6/2007 | Tseng | |
| 2007/0201221 | A1 | 8/2007 | Cherdak et al. | |
| 2007/0211451 | A1 | 9/2007 | Chung | |
| 2007/0236915 | A1 | 10/2007 | Chen | |
| 2008/0110049 | A1 | 5/2008 | Sokolowski et al. | |
| 2008/0163976 | A1 | 7/2008 | Lalande et al. | |
| 2009/0007459 | A1 | 1/2009 | Barnett | |
| 2009/0158622 | A1 | 6/2009 | Cook et al. | |
| 2010/0154256 | A1 | 6/2010 | Dua | |
| 2010/0251491 | A1 | 10/2010 | Dojan et al. | |
| 2010/0263236 | A1 | 10/2010 | Carboy et al. | |
| 2011/0061154 | A1 | 3/2011 | Turner et al. | |
| 2011/0094127 | A1 | 4/2011 | Dana, III | |
| 2011/0192053 | A1 | 8/2011 | Beers | |
| 2011/0192058 | A1 | 8/2011 | Beers et al. | |
| 2011/0192059 | A1 * | 8/2011 | Spanks et al. | 36/137 |
| 2012/0007504 | A1 | 1/2012 | Beers et al. | |
| 2014/0068974 | A1 | 3/2014 | Spanks et al. | |
| 2014/0075785 | A1 | 3/2014 | Spanks et al. | |

FOREIGN PATENT DOCUMENTS

| | | |
|---|---|---|
| FR | 2643794 | 9/1990 |
| JP | 10225305 | 8/1998 |
| WO | 9415494 | 7/1994 |

OTHER PUBLICATIONS

Response to Office Action dated Oct. 12, 2012, filed Jan. 14, 2013 in U.S. Appl. No. 12/704,126.

Notice of Allowance dated Jun. 3, 2013 in U.S. Appl. No. 12/704,126.

* cited by examiner

ARTICLE OF FOOTWEAR INCORPORATING ILLUMINABLE STRANDS

CROSS-REFERENCE TO RELATED APPLICATION

This application is a continuation of Beers et al., U.S. Patent Application Publication No. 2011/0192058, published on Aug. 11, 2011, the entire disclosure of which is incorporated herein by reference.

BACKGROUND

Articles of footwear generally include two primary elements, an upper and a sole structure. The upper may be formed from a variety of material elements (e.g., textiles, polymer sheets, foam layers, leather, synthetic leather) that are stitched or adhesively bonded together to form a void for comfortably and securely receiving a foot. More particularly, the upper generally extends over the instep and toe areas of the foot, along the medial and lateral sides of the foot, under the foot, and around the heel area of the foot. In some articles of footwear, such as basketball shoes and boots, the upper may extend upward and around the ankle to provide support or protection for the ankle. Access to the void within the upper is generally provided by an ankle opening in a heel region of the footwear. A lacing system is often incorporated into the upper to adjust the fit of the upper, as well as permitting entry and removal of the foot from the void within the upper. In addition, the upper may include a tongue that extends under the lacing system to enhance adjustability and comfort of the footwear.

The sole structure is secured to a lower portion of the upper and is generally positioned between the foot and the ground. In many articles of footwear, including athletic footwear, the sole structure incorporates a sockliner, a midsole, and an outsole. The sockliner is a thin, compressible member located within the void (i.e., under the foot) to enhance footwear comfort. The midsole extends downward from the upper and forms a middle layer of the sole structure. In addition to attenuating ground reaction forces (i.e., providing cushioning for the foot), the midsole may limit foot motions or impart stability, for example. Although the midsole of athletic footwear may be primarily formed from a foamed polymer material, the midsole may include a variety of additional footwear elements that enhance the comfort or performance of the footwear, including plates, moderators, fluid-filled chambers, lasting elements, or motion control members. The outsole is secured to a lower surface of the midsole and forms a ground-contacting portion of the footwear. Additionally, the outsole may be formed from a durable and wear-resistant material that includes texturing to improve traction.

SUMMARY

An article of footwear is disclosed herein as including an upper and a sole structure secured to the upper. The upper includes at least one illuminable strand located to be visible from an exterior of the article of footwear. Additionally, the upper includes a power source at least partially embedded within the upper and electrically-coupled to the illuminable strand.

An article of footwear may also incorporate an upper with a foundation layer, a cover layer, and at least one electroluminescent wire. The foundation layer and cover layer are secured to each other. The cover layer forms at least a portion of an exterior surface of the upper, and the cover layer is formed from an at least semi-transparent material. The electroluminescent wire is located between the foundation layer and the cover layer, and the electroluminescent wire lays adjacent to the foundation layer for a distance of at least five centimeters.

Additionally, an article of footwear may have an upper with a lace region, a lower region, and a plurality of sections of electroluminescent wire. The lace region has a plurality of lace-receiving elements. The lower region is located where the sole structure is secured to the upper. The sections of electroluminescent wire extend from the lace region to the lower region.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of an article of footwear 10 that incorporates illuminable elements. Concepts related to the illuminable elements are disclosed with reference to footwear that is suitable for running. The illuminable elements are not limited to footwear designed for running, however, and may be utilized with a wide range of athletic footwear styles, including basketball shoes, cross-training shoes, cycling shoes, football shoes, soccer shoes, tennis shoes, and walking shoes, for example. The illuminable elements may also be utilized with footwear styles that are generally considered to be non-athletic, including dress shoes, loafers, sandals, and boots. The concepts disclosed herein may, therefore, apply to a wide variety of footwear styles, in addition to the specific style discussed in the following material and depicted in the accompanying figures.

General Footwear Configuration

Figure 1:
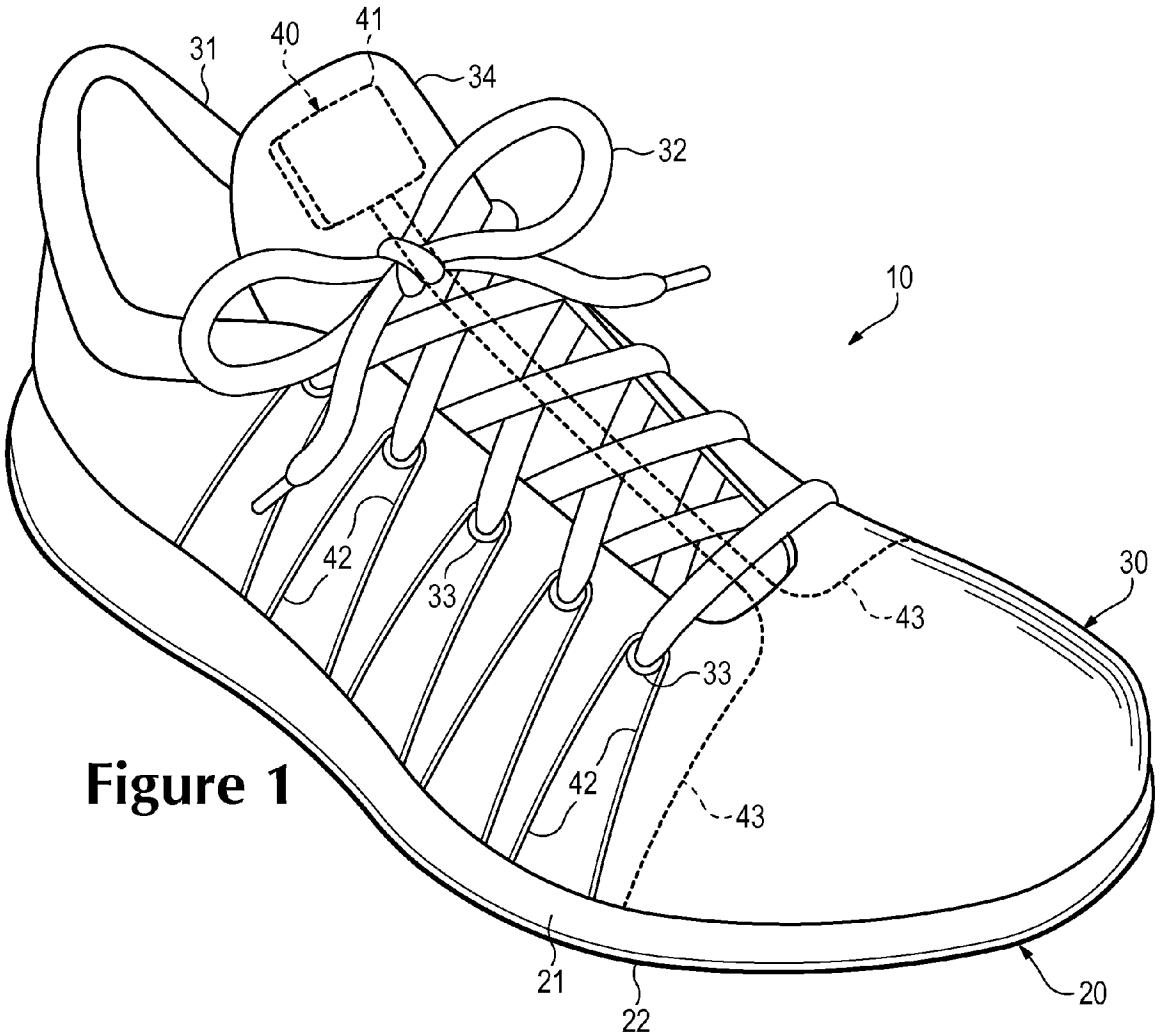
FIG. 1 is a perspective view of an article of footwear.
Figure 2:
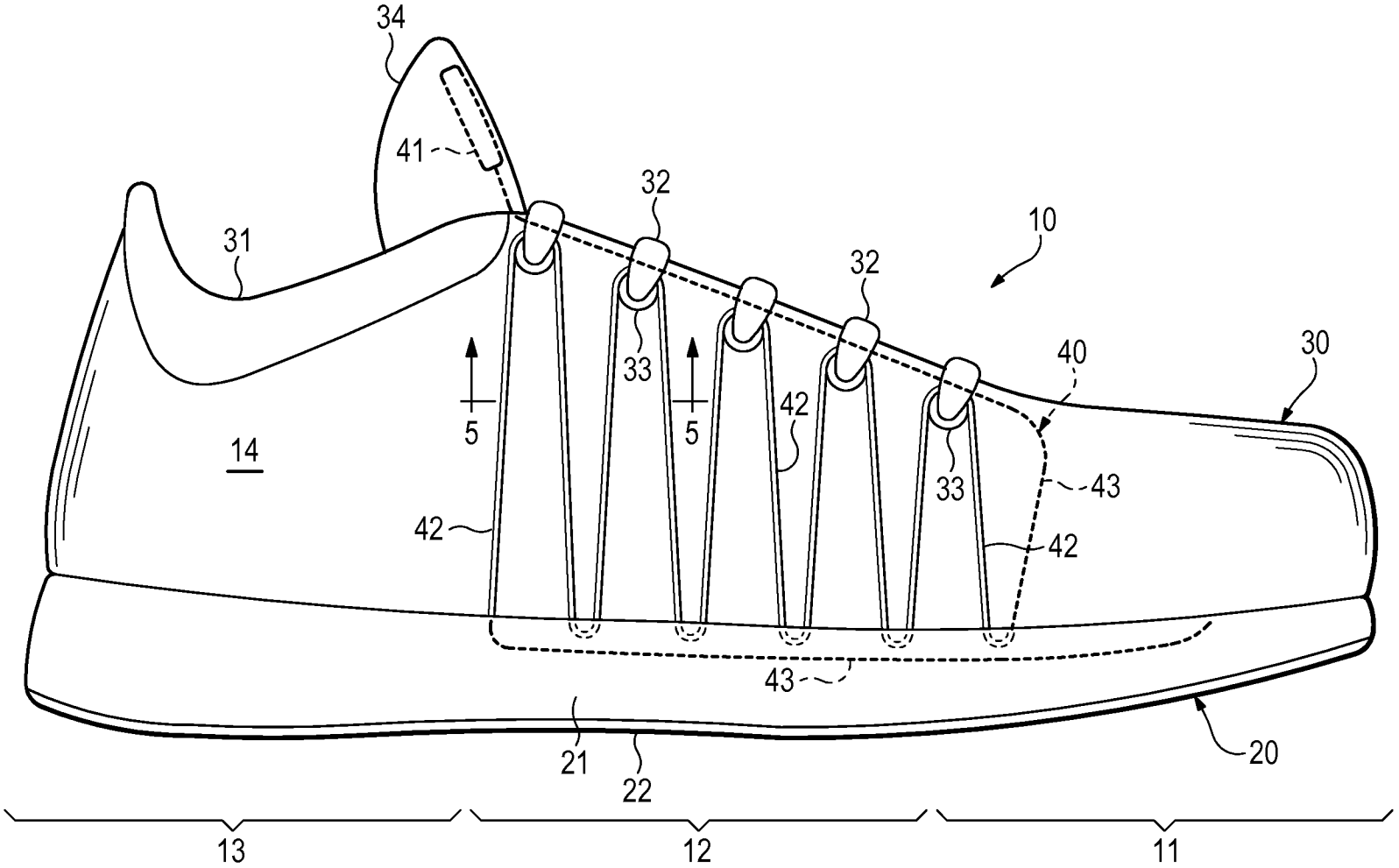
FIG. 2 is a lateral side elevational view of the article of footwear.
Figure 3:
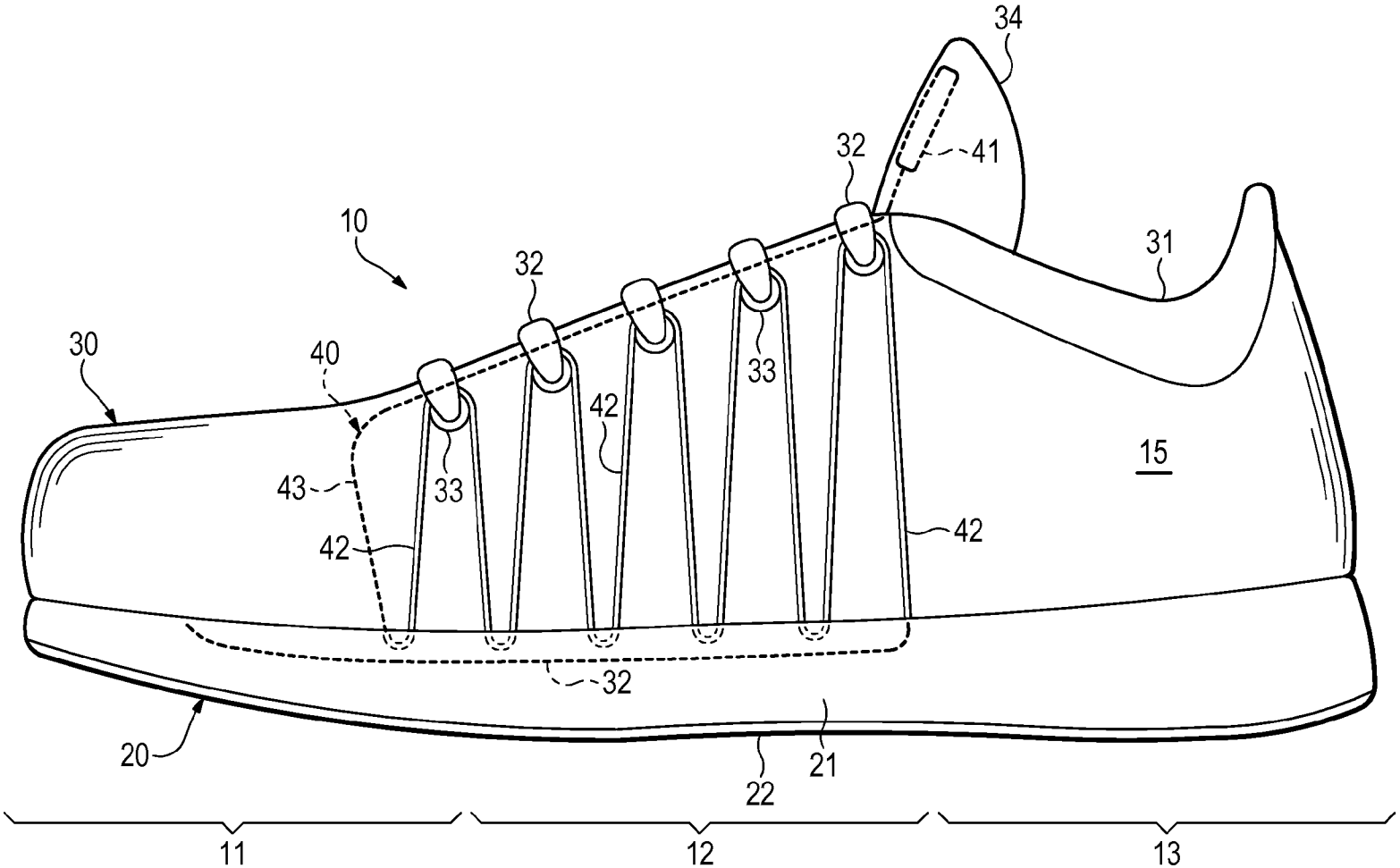
FIG. 3 is a medial side elevational view of the article of footwear.

Footwear 10 is depicted in FIGS. 1-3 as including a sole structure 20, an upper 30, and an illumination circuit 40. In general, illumination circuit 40 is utilized to illuminate portions of footwear 10 (e.g., sides of upper 30). In addition to imparting a unique aesthetic to footwear 10 and enhancing enjoyment of the wearer of footwear 10, illuminating portions of footwear 10 may increase the visibility of (a) the wearer, thereby making the wearer more visible to others in low light or darkened conditions and (b) obstacles or aspects of the ground (e.g., road, trail, running path), thereby making the obstacles more visible to the wearer. Illuminating portions of footwear 10 may also be utilized during product testing to enhance the visibility of areas of footwear 10 that are subjected to tensile, compression, bending, or twisting forces. That is, illuminating areas of footwear 10 may improve the degree to which the areas of footwear 10 are visible on high-speed film or other mediums that visually-capture performance data during biomechanical or other forms of testing.

Figure 4:
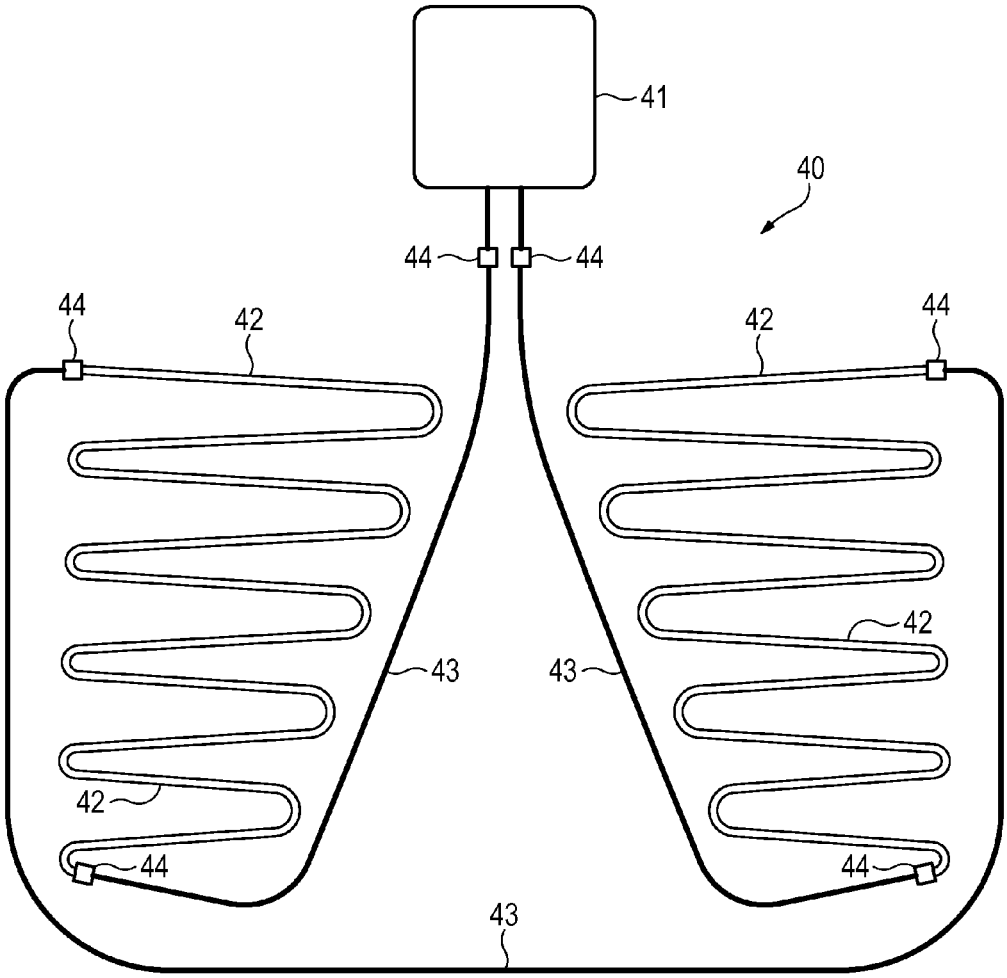
FIG. 4 is a schematic diagram of an illumination circuit of the article of footwear.

For reference purposes, footwear 10 may be divided into three general regions: a forefoot region 11, a midfoot region 12, and a heel region 13, as shown in FIGS. 3 and 4. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, illumination circuit 40, and individual elements thereof.

Sole structure 20 is secured to upper 30 and extends between the foot and the ground when footwear 10 is worn. The primary elements of sole structure 20 are a midsole 21 and an outsole 22. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate plates, moderators, fluid-filled chambers, lasting elements, or motion control members that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. A sockliner may also be located within upper 30 and positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

Upper 30 defines a void within footwear 10 for receiving and securing a foot relative to sole structure 20. The void is shaped to accommodate the foot and extends along the lateral side of the foot, along the medial side of the foot, over the foot, around the heel, and under the foot. Access to the void is provided by an ankle opening 31 located in at least heel region 13. A lace 32 extends through various lace apertures 33 or other lace-receiving elements (e.g., D-rings, hooks) and permits the wearer to modify dimensions of upper 30 to accommodate the proportions of the foot. More particularly, lace 32 permits the wearer to tighten upper 30 around the foot, and lace 32 permits the wearer to loosen upper 30 to facilitate entry and removal of the foot from the void (i.e., through ankle opening 31). In addition, upper 30 includes a tongue 34 that extends between the interior void and lace 32

The various portions of upper 30 may be formed from one or more of a plurality of material elements (e.g., textiles, polymer sheets, foam layers, leather, synthetic leather) that are stitched or bonded together to form the void within footwear 10. Upper 30 may also incorporate a heel counter that limits heel movement in heel region 13 or a wear-resistant toe guard located in forefoot region 11. Although a variety of material elements or other elements may be incorporated into upper, areas of lateral side 14 and medial side 15 incorporate portions of illumination circuit 40 and are illuminated by illumination circuit 40, as discussed in greater detail below.

Illumination Circuit

Illumination circuit 40 is depicted in FIG. 4 and includes a power source 41, a pair of illuminable elements 42, lead wires 43, and various connectors 44. In general, power source 41 delivers current and voltage to illuminable elements 42 through the various lead wires 43 and connectors 44, thereby inducing illuminable elements 42 to illuminate or otherwise emit light. Each of illuminable elements 42 are incorporated into one of lateral side 14 and medial side 15 of upper 30 and have a configuration of, for example, electroluminescent wire (i.e., EL wire), one or more light emitting diodes, or an electroluminescent panel. When illuminated, light emitted from illuminable elements 42 is visible from an exterior of footwear 10.

Illuminable elements 42, as noted above, may have the configuration of electroluminescent wire. In general, electroluminescent wire has a concentric series of layers that include: (a) a central conductive wire, such as copper wire, (b) an electroluminescent phosphor coating that extends around the conductive wire, (c) a relatively fine conductive wire that wraps around the phosphor coating, and (d) an exterior polymer sheath, which is often formed as two layers of polyvinyl chloride, one of which may be colored. In operation, power source 41 delivers alternating current to illuminable elements 42 through the various lead wires 43 and connectors 44. The alternating current passes through the central conductive wire and the relatively fine conductive wire, which produces an alternating electric field that induces the phosphor coating to glow or otherwise emit light. Although the frequency of the alternating electric field has an effect upon the wavelength of the light emitted from the phosphor coating, coloring in the polymer sheath imparts specific colors to the light that is emitted from illuminable elements 42.

Power source 41 is depicted as being incorporated into upper 30, particularly tongue 34. In general, power source 41 may be any oscillating electric potential source, including an alternating current source, a direct current to alternating current converter output (i.e., the output of a battery and an inverter), or an electric oscillator (i.e., a sine wave generator, a square wave generator, or a tuned LC oscillator), for example. As a more specific example, power source 41 may include (a) a rechargeable polymer lithium-ion battery having an output of 3.7 volts and 300 milliampere hours and (b) an inverter providing an output of 264-330 volts peak-to-peak at a frequency of 425-525 hertz. Depending upon various factors, however, the battery and inverter specification may vary significantly. For example, the desired (a) length of the electroluminescent wire forming illuminable elements 42, (b) intensity of the light output of illuminable elements 42, and (c) time during which illuminable elements 42 are to remain illuminated may all affect specifications for the battery and inverter utilized in power source 41. Although power source 41 is depicted as being a single component that includes the battery and inverter, power source 41 may also be a separate battery and inverter within illumination circuit 40. Additionally, power source 41 may include (a) a switch that permits the wearer to selectively emit light or vary the intensity of the light output and (b) a connector for recharging the battery. Accordingly, power source 41 may have a variety of configurations that are sufficient to illuminate illuminable elements 42.

Lead wires 43 have the configuration of any electrically-conductive material, such as insulated copper wire, and are electrically-coupled to power source 41 with a pair of connectors 44. Given that power source 41 is located in an upper area of tongue 34, lead wires 43 extend along the length of tongue 34, pass through sides 14 and 15 of upper 30, and are electrically-coupled to illuminable elements 42 with another pair of connectors 44. A further lead wire 43 is electrically-coupled to illuminable elements 42 with another pair of connectors 44 to complete the circuit. Although this general configuration provides an efficient manner of joining the various elements of illumination circuit 40, other layouts or methods of distributing the elements of illumination circuit 40 may also be utilized. Moreover, connectors 44 may have a variety of configurations that are suitable for joining electrical components, and lead wires 43 may be formed to join with power source 41 and illuminable elements 42 without connectors (e.g., with soldered connections) in some configurations of footwear 10.

Upper Configuration

Figure 5:
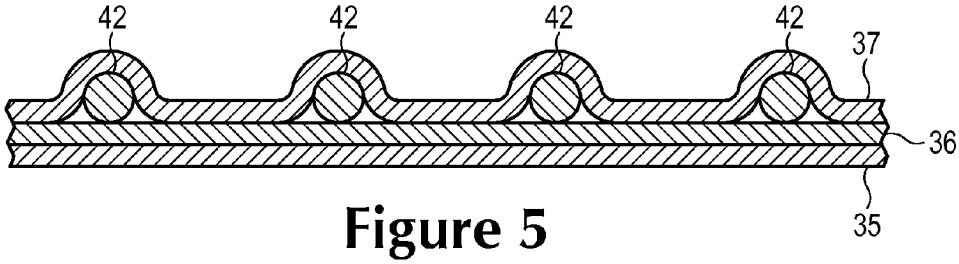
FIG. 5 is a cross-sectional view of the article of footwear, as defined by section line 5-5 in FIG. 2.

A cross-sectional view of a portion of upper 30 that incorporates one of illuminable elements 42 is depicted in FIG. 5. In this area, upper 30 includes a first foundation layer 35, a second foundation layer 36, various sections of the electroluminescent wire that form illuminable elements 42, and a cover layer 37. Foundation layers 35 and 36 may be any of the various types of material elements that generally form upper 30, including textiles, polymer sheets, foam layers, leather, synthetic leather. Although two foundation layers 35 and 36 are depicted, additional foundation layers may also be present in footwear 10, or only one of foundation layers 35 and 36 may be present.

Illuminable elements 42 are located between second foundation layer 36 and cover layer 37. In general, illuminable elements 42 lay adjacent to, parallel to, and in contact with surfaces of second foundation layer 36 and cover layer 37. As discussed in greater detail below, illuminable elements 42 may form structural components in upper 30 that resist stretch. By being substantially parallel to second foundation layer 36 and cover layer 37, illuminable elements 42 resist stretch in directions that correspond with the planes upon which second foundation layer 36 and cover layer 37 lay. Although the configuration of upper 30 may vary significantly, illuminable elements 42 may extend parallel to second foundation layer 36 and cover layer 37 for a distance of at least five centimeters in order to enhance the degree of stretch resistance imparted by illuminable elements 42.

Cover layer 37 may be formed from any generally transparent or at least partially transparent material that permits light from illuminable elements 42 to be visible from an exterior of footwear 10. As an example, cover layer 37 may be formed from a thermoplastic polyurethane sheet. Although cover layer 37 may be bonded or otherwise secured to illuminable elements 42 and second foundation element 36, cover layer 37 may also be unsecured to one or both of illuminable elements 42 and second foundation element 36. Additionally, cover layer 37 may form protrusions on the exterior of upper 30 in areas where illuminable elements 42 are located, as depicted in FIG. 5. The protrusions may arise as a result of a molding process for forming upper 30 that may be similar to a molding process disclosed in U.S. patent Ser. No. 12/419,985, which was filed in the U.S. Patent and Trademark Office on 7 Apr. 2009 and entitled Method For Molding Tensile Strand Elements, such application being entirely incorporated herein by reference.

During walking, running, or other ambulatory activities, a foot within the void in footwear 10 may tend to stretch upper 30. That is, many of the material elements forming upper 30 may stretch when placed in tension by movements of the foot. In comparison with the stretch of the material elements forming upper 30, illuminable elements 42 may stretch to a lesser degree, particularly when formed from electroluminescent wire. Various sections of illuminable elements 42 may be located, therefore, to form structural components in upper 30 that resist stretching in specific directions or reinforce locations where forces are concentrated. With regard to the configuration depicted in FIGS. 1-3, one of illuminable elements 42 is located on lateral side 14 of upper 30 and another of illuminable elements 42 is located on medial side 15 of upper 30. In general, each of illuminable elements 42 have various sections that extend between the area of upper 30 that receives lace 32 and a lower area of upper 30 where sole structure 20 is secured. That is, sections of illuminable elements 42 (e.g. different sections or segments of a single electroluminescent wire) extend between lace apertures 33 and sole structure 20 to resist stretch in the medial-lateral direction (i.e., in a direction extending around upper 30). Illuminable elements 42 are also positioned around and radiate outward from lace apertures 33 to resist stretch due to tension in lace 32. Accordingly, illuminable elements 42 may be located to form structural components in upper 30 that resist stretch.

Illuminable elements 42 may extend around the various lace apertures 33 or other lace-receiving elements of footwear 10. In general, illuminable elements zigzag along upper 30 to extend around a one of lace apertures 33, extend downward toward sole structure 30, extend upward and around another lace aperture 33, again extend downward again toward sole structure 30, and again extend upward and around yet another lace aperture 33. In general, therefore, a first group of sections of one of illuminable elements 42 extends outward from one of lace apertures 33 and toward the lower region of upper 30, and a second group of sections of the one of illuminable elements 42 extends outward from another of lace apertures 33 and toward the lower region of upper 30. In this manner, numerous sections of illuminable elements 42 extend between a lace region of upper 30 and a lower region of upper 30.

Further Footwear Configurations

Figure 6A:
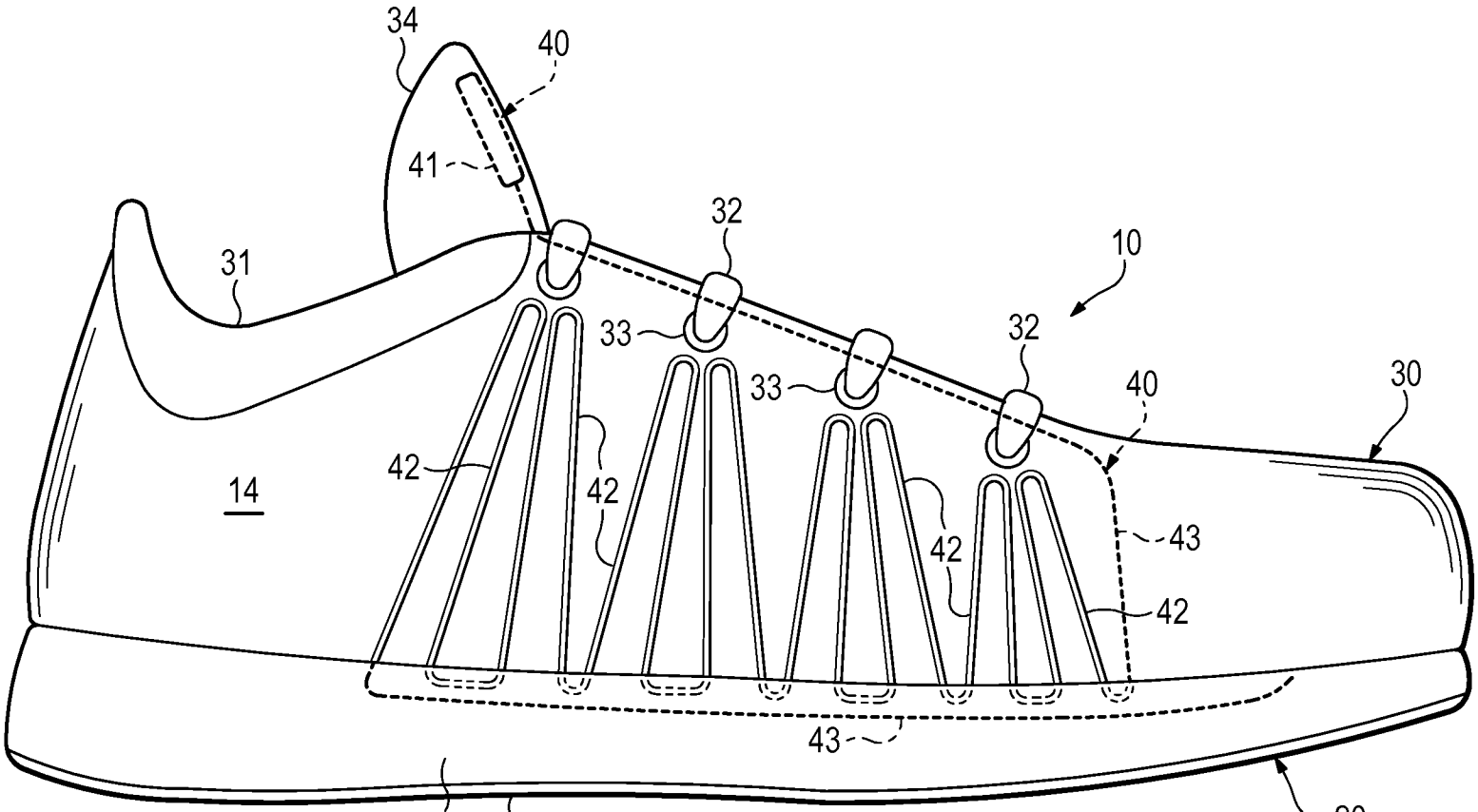
FIGS. 6A-6E are lateral side elevational views corresponding with FIG. 2 and depicting further configurations of the article of footwear.
Figure 6B:
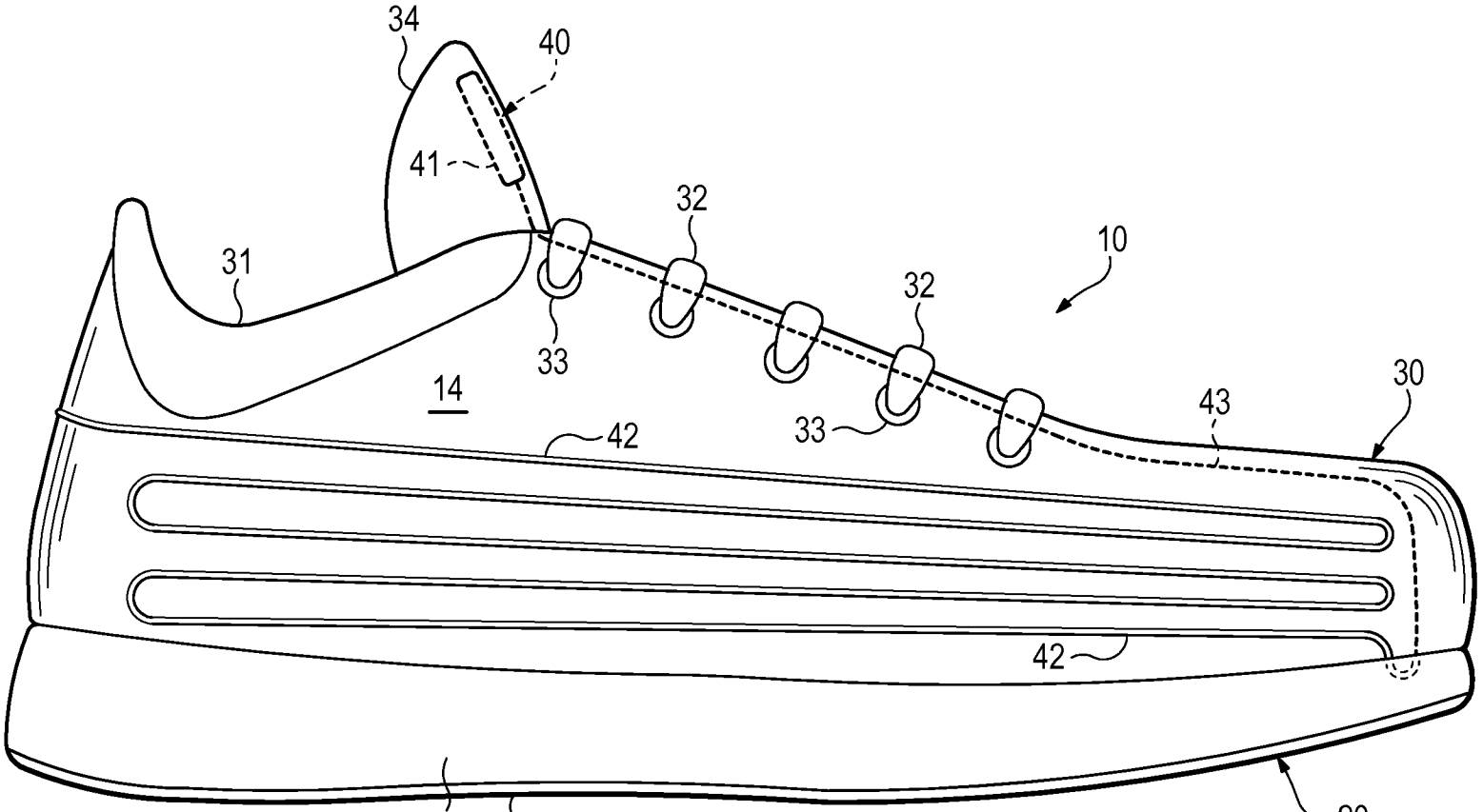
Figure 6C:
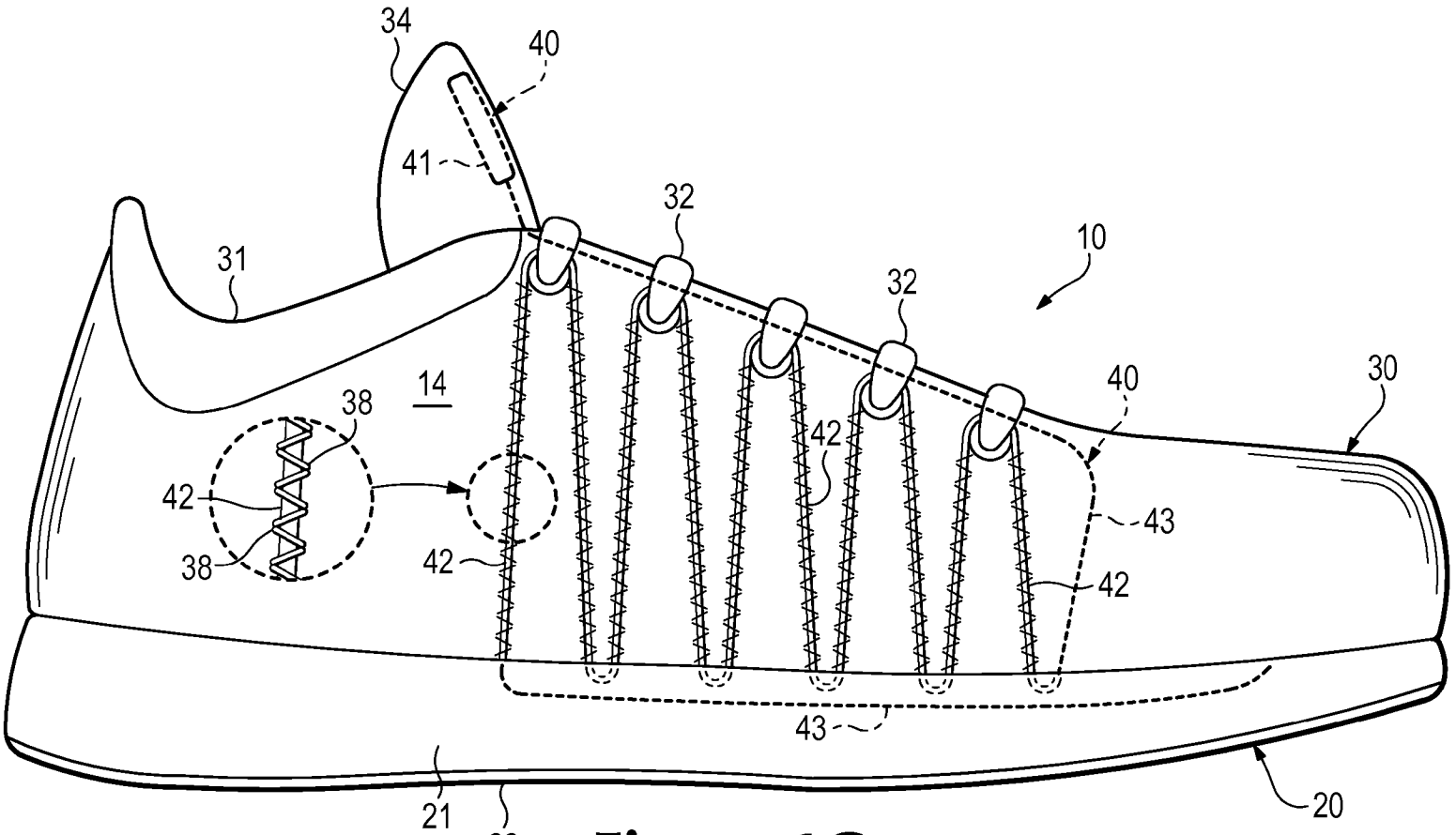

The overall configuration of footwear 10 discussed above is intended to provide an example of a suitable configuration for imparting an illuminable aspect to upper 30. In other configurations of footwear 10, various aspects of sole structure 20, upper 30, and illumination circuit 40 may vary considerably. Although illuminable elements 42 may extend around lace apertures 33, a configuration wherein illuminable elements 42 extend downward from areas that are proximal to lace apertures 33 is depicted in FIG. 6A. Moreover, this configuration illustrates a structure wherein four sections of illuminable elements 42 extend downward toward sole structure 20 from each lace aperture 33. Although illuminable elements 42 may extend in a generally vertical direction, FIG. 6B depicts a configuration wherein illuminable elements 42 extend longitudinally through regions 11-13 along the length of footwear 10. In this manner, illuminable elements may be utilized to resist longitudinal stretch in upper 30. Cover layer 37 extends over illuminable elements 42 in the various configurations discussed above. In another configuration, a securing strand 38 may follow a zigzag pattern over illuminable elements 42, as depicted in FIG. 6C, to secure illuminable elements 42 to foundation layers 35 and 36. This method of securing illuminable elements 42 to upper 30 may be similar to a method of securing strands disclosed in U.S. patent Ser. No. 12/546,022, which was filed in the U.S. Patent and Trademark Office on 24 Aug. 2009 and entitled Article Of Footwear Incorporating Tensile Strands And Securing Strands, such application being entirely incorporated herein by reference.

Figure 6D:
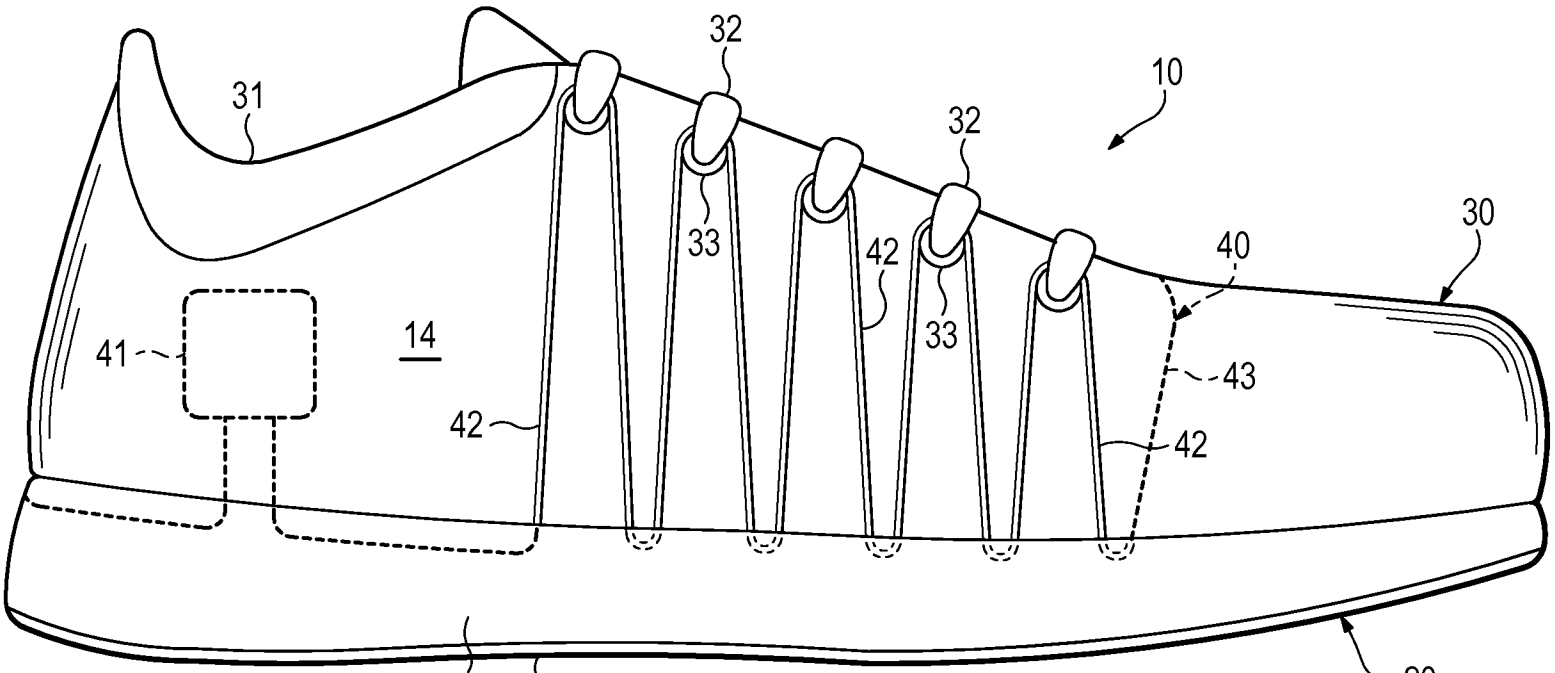

The locations of various elements of illumination circuit 40 may vary. As discussed above, for example, illuminable elements 42 may extend longitudinally or may not extend around lace apertures 33. As another example, the specific location of power source 41 may vary depending upon the desired aesthetics, comfort, or other properties of footwear 10. Referring to FIG. 6D, power source 41 is depicted as being located in heel region 13 and on lateral side 14. In other configurations, however, power source 41 may be located in any of regions 11-13 and also on medial side 15. When a separate battery and inverter are utilized for power source 41, the battery and inverter may also be located in different regions or sides of footwear 10. Moreover, power source 41 may also be embedded within sole structure 20 in some configurations of footwear 10.

Figure 6E:
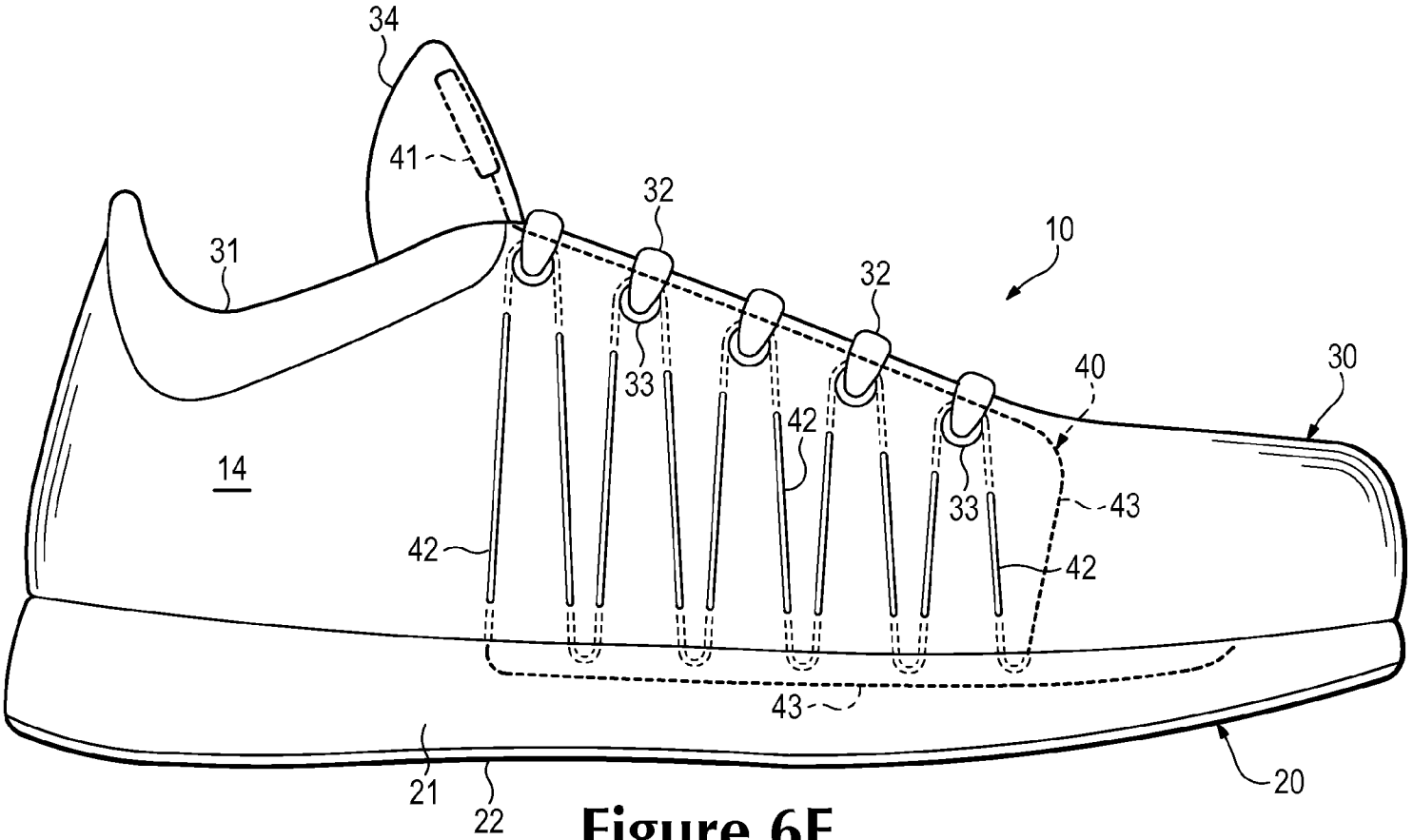

Although illuminable elements 42 may lay adjacent to foundation layer 36 and be exterior of foundation layer 36, illuminable elements 42 may also extend through second foundation layer 36 and toward an interior of upper 30, as depicted in FIG. 6E. That is, illuminable elements 42 may protrude through second foundation layer 36 and extend into a more interior area of upper 20 (i.e., between foundation layers 35 and 36 or inward of first foundation layer 35). An advantage of this configuration is that illuminable elements 42 have the appearance of discrete or separate strands on upper 30, and illuminable elements 42 may be routed to various areas of footwear 10 in a non-visible manner.

Figure 7A:
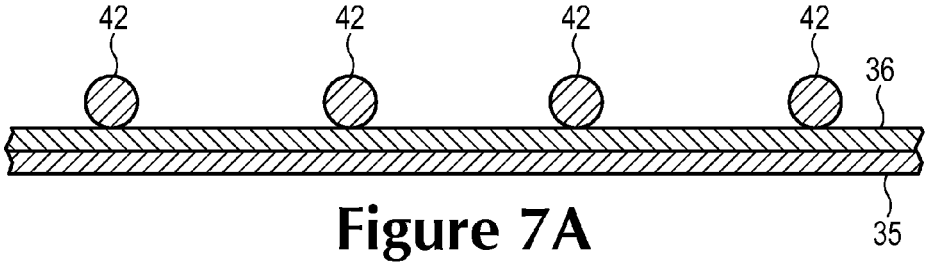
FIGS. 7A-7C are cross-sectional views corresponding with FIG. 4 and depicting further configurations of the article of footwear.
Figure 7B:
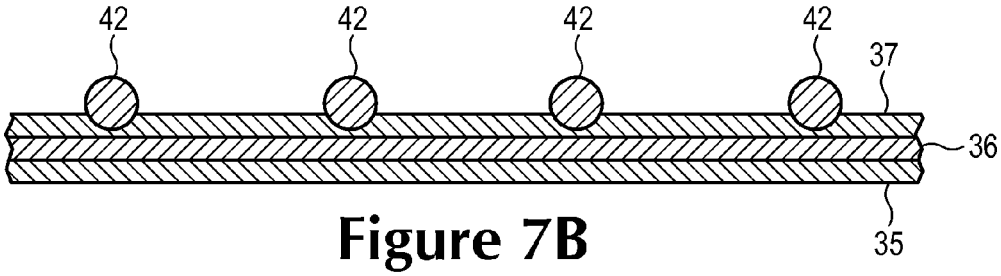
Figure 7C:
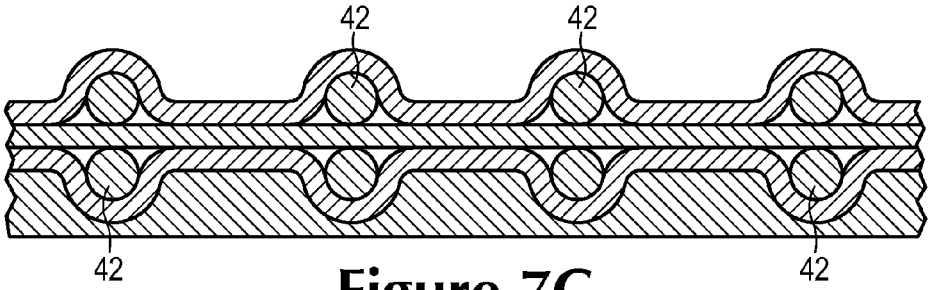

The layered configuration of upper 30 may also vary in further configurations of footwear 10. Referring to FIG. 7A, cover layer 37 may be absent such that illuminable elements 42 are exposed on the exterior of footwear 10. Illuminable elements 42 may also be embedded in an exterior surface of cover layer 37, as depicted in FIG. 7B. Additionally, sections of illuminable elements 42 may be stacked or otherwise located on opposite sides of layers, as depicted in FIG. 7C.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear having an upper and a sole structure secured to the upper, the upper comprising:

at least one illuminable strand located to be visible from an exterior of the article of footwear; and a power source at least partially embedded within the upper and electrically-coupled to the illuminable strand;

the illuminable strand having a concentric series of layers that including an exterior polymer sheath through which light is emitted;

wherein the illuminable strand extends upward and proximate to a first lace-receiving element in a lace region of the upper, extends downward from the first lace-receiving element toward the sole structure, and extends upward and proximate to a second lace-receiving element of the upper, thereby reinforcing the upper between the lace-receiving elements and the sole structure.

2. The article of footwear recited in claim 1, wherein the illuminable strand is an electroluminescent wire.

3. The article of footwear recited in claim 1, wherein the upper includes (a) a first layer that forms at least a portion of an exterior surface of the upper and (b) a second layer that is positioned inward of the first layer, the illuminable strand being located between the first layer and the second layer.

4. The article of footwear recited in claim 3, wherein the first layer is formed from an at least partially transparent material.

5. The article of footwear recited in claim 3, wherein portions of the first layer that contact the illuminable strand protrude outward to form protrusions on the exterior surface of the upper.

6. The article of footwear recited in claim 3, wherein the illuminable strand lays adjacent to a surface of the second layer for a distance of at least five centimeters.

7. The article of footwear recited in claim 1, wherein at least a portion of the illuminable strand extends between a lace region of the upper and a region where the sole structure is joined to the upper.

8. The article of footwear recited in claim 1, wherein a plurality of sections of the illuminable strand extend between a lace region of the upper and a region where the sole structure is joined to the upper.

9. The article of footwear recited in claim 8, wherein the sections radiate outward from a lace-receiving element of the lace region.

10. An article of footwear having an upper and a sole structure secured to the upper, the upper comprising:

a foundation layer and a cover layer that are secured to each other, the cover layer forming at least a portion of an exterior surface of the upper, and the cover layer being formed from an at least semi-transparent material; and at least one electroluminescent wire located between the foundation layer and the cover layer, the electroluminescent wire laying adjacent to the foundation layer for a distance of at least five centimeters;

wherein the electroluminescent wire extends upward and proximate to a first lace-receiving element in a lace region of the upper, extends downward from the first lace-receiving element toward the sole structure, and extends upward and proximate to a second lace-receiving element of the upper, thereby reinforcing the upper between the lace-receiving elements and the sole structure.

11. The article of footwear recited in claim 10, wherein portions of the cover layer that contact the electroluminescent wire protrude outward to form protrusions on the exterior surface of the upper.

12. The article of footwear recited in claim 10, wherein at least a portion of the electroluminescent wire extends between the lace region of the upper and a region where the sole structure is joined to the upper.

13. The article of footwear recited in claim 10, wherein a plurality of sections of the electroluminescent wire extend between the lace region of the upper and a region where the sole structure is joined to the upper.

14. The article of footwear recited in claim 13, wherein the sections radiate outward from a lace-receiving element of the lace region.

15. An article of footwear having an upper and a sole structure secured to the upper, the upper comprising:

a lace region having a plurality of lace-receiving elements;

a lower region where the sole structure is secured to the upper; and a plurality of sections of electroluminescent wire extending from the lace region to the lower region;

wherein the electroluminescent wire extends upward and proximate to a first lace-receiving element of the plurality of lace-receiving elements, extends downward from the first lace-receiving element toward the sole structure, and extends upward and proximate to a second lace-receiving element of the plurality of lace-receiving elements, thereby reinforcing the upper between the lace-receiving elements and the sole structure.

16. The article of footwear recited in claim 15, wherein the sections of electroluminescent wire are different segments of a single electroluminescent wire.

17. The article of footwear recited in claim 15, wherein the lace receiving elements include a first lace-receiving element and a second lace-receiving element, a first group of the sections of electroluminescent wire extends from the first lace-receiving element toward the lower region, and a second group of the sections of electroluminescent wire extends from the second lace-receiving element toward the lower region.

18. The article of footwear recited in claim 17, wherein the first group of the sections of electroluminescent wire radiate outward from the first lace-receiving element.

19. The article of footwear recited in claim 15, wherein the upper includes a cover layer formed from an at least semi-transparent material, the cover layer extending over the sections of electroluminescent wire and forming a portion of an exterior surface of the upper.

20. The article of footwear recited in claim 15, wherein a power source is at least partially embedded within the upper and electrically-joined to the sections of electroluminescent wire.

* * * * *